US010293202B2

(12) United States Patent
Hoobler

(10) Patent No.: US 10,293,202 B2
(45) Date of Patent: May 21, 2019

(54) FITNESS TRAINING SYSTEM

(71) Applicant: Colin Hoobler, Portland, OR (US)

(72) Inventor: Colin Hoobler, Portland, OR (US)

( * ) Notice: Subject to any disclaimer, the term of this patent is extended or adjusted under 35 U.S.C. 154(b) by 372 days.

(21) Appl. No.: 15/379,246

(22) Filed: Dec. 14, 2016

(65) Prior Publication Data

US 2017/0216657 A1 Aug. 3, 2017

Related U.S. Application Data

(60) Provisional application No. 62/296,805, filed on Feb. 18, 2016, provisional application No. 62/288,694, filed on Jan. 29, 2016.

(51) Int. Cl.

| | |
|---|---|
| ***A63B 21/00*** | (2006.01) |
| ***A63B 21/04*** | (2006.01) |
| ***A63B 22/20*** | (2006.01) |
| ***A63B 23/00*** | (2006.01) |
| ***A63B 23/04*** | (2006.01) |
| ***A63B 23/12*** | (2006.01) |
| ***A63B 26/00*** | (2006.01) |
| ***A63B 69/00*** | (2006.01) |
| ***A63B 71/00*** | (2006.01) |
| ***A63B 71/02*** | (2006.01) |
| ***A63B 21/055*** | (2006.01) |

(52) U.S. Cl.

CPC .... *A63B 21/4035* (2015.10); *A63B 21/00047* (2013.01); *A63B 22/20* (2013.01); *A63B 23/04* (2013.01); *A63B 23/0405* (2013.01); *A63B 23/1209* (2013.01); *A63B 69/0057* (2013.01); *A63B 71/0009* (2013.01); *A63B 21/0442* (2013.01); *A63B 21/0552* (2013.01); *A63B 23/0458* (2013.01); *A63B 26/003* (2013.01); *A63B 2023/006* (2013.01); *A63B 2071/0018* (2013.01); *A63B 2071/025* (2013.01); *A63B 2208/0233* (2013.01); *A63B 2225/093* (2013.01)

(58) Field of Classification Search

CPC ..... A63B 1/00; A63B 3/00; A63B 21/068; A63B 23/1209–1227; A61H 3/04

See application file for complete search history.

(56) References Cited

U.S. PATENT DOCUMENTS

| | | | | |
|---|---|---|---|---|
| 4,226,413 | A * | 10/1980 | Daugherty | A61H 3/04 188/1.12 |
| 5,407,404 | A | 4/1995 | Killian et al. | |
| 5,538,268 | A * | 7/1996 | Miller | A61H 3/04 280/87.041 |
| D525,668 | S * | 7/2006 | Payne | D21/691 |
| 7,850,576 | B2 * | 12/2010 | Sellke | A63B 63/004 273/407 |

(Continued)

FOREIGN PATENT DOCUMENTS

CN 203342285 U 12/2013

OTHER PUBLICATIONS

International Search Report, and Written Opinion, dated Mar. 9, 2017, PCT International Application No. PCT/US16/66682, filed Dec. 14, 2016, 13 pgs.

(Continued)

*Primary Examiner* — Jennifer M Deichl

(74) *Attorney, Agent, or Firm* — Chernoff, Vilhauer, McClung & Stenzel, LLP

(57) ABSTRACT

An exercise apparatus that includes a handle frame and a base frame.

8 Claims, 5 Drawing Sheets

(56) References Cited

U.S. PATENT DOCUMENTS

| | | | | |
|---|---|---|---|---|
| 2002/0098954 | A1 | 7/2002 | Buechel et al. | |
| 2006/0217246 | A1* | 9/2006 | Payne | A63B 21/00047 482/96 |
| 2007/0034243 | A1* | 2/2007 | Miller | A61H 3/04 135/67 |
| 2008/0227609 | A1* | 9/2008 | Barniak | A63B 3/00 482/142 |
| 2012/0329626 | A1 | 12/2012 | Meredith et al. | |
| 2013/0102443 | A1 | 4/2013 | Lundquist et al. | |
| 2013/0324383 | A1* | 12/2013 | Rogers | A63B 26/00 482/142 |
| 2014/0200123 | A1 | 7/2014 | Placide | |
| 2014/0274607 | A1 | 9/2014 | Kaye | |
| 2014/0319792 | A1* | 10/2014 | Miller | A61H 3/04 280/87.041 |
| 2016/0296792 | A1* | 10/2016 | Mosher | A63B 23/0238 |

OTHER PUBLICATIONS

PLR-490 Hip Flexion/Dip Station/Push Up (Promaxima), Mar. 24, 2015, <http://web/archive.org/web/20150324084026/http:/;/www.promaxima.com/hip-flexion-and-dip-station-with-push-up.html>, 1 pg.

A Complete Review of the Smooth CE 2.1 Elliptical Trainer, Building Muscle, Dec. 10, 2015, <http://web.archive.org/web/20151210034808/http://www.building-muscle101.com/smooth-ce-2-1-elliptical-trainer.html>, 6 pgs.

* cited by examiner

FITNESS TRAINING SYSTEM

CROSS-REFERENCE TO RELATED APPLICATIONS

This application claims the benefit of U.S. Provisional Application No. 62/296,805, filed Feb. 18, 2016, and claims the benefit of U.S. Provisional Application No. 62/288,694, filed Jan. 29, 2016.

BACKGROUND OF THE INVENTION

Exercise regimens are necessary for individuals desiring to improve their physical well-being, individuals seeking to maintain their physical health, or those that are recovering from injuries or surgery. Although fitness facilities provide a wide range of equipment to meet those needs, the home-user is limited in his or her equipment choices.

In addition, there is growing concern that senior adults require some type of home exercise more than younger adults. Senior adults are more susceptible to a variety of conditions including osteoporosis, falls, fractures and balance control problems. While the conditions pose a risk for anyone, they are especially serious for senior adults who may be alone when the injury occurs and unable to summon for assistance, who incur injuries more easily than younger adults and who also recover more slowly than their younger brethren.

In addition, people recovering from hip or knee replacement surgery require lengthy periods of physical therapy. Usually this is a combination of out-patient physical therapy combined with an in-home exercise regimen. However, due to the limited selection of home equipment available to the patient, home exercise programs are limited in scope, especially to those patients who require a wheel chair for mobility.

The foregoing and other objectives, features, and advantages of the invention may be more readily understood upon consideration of the following detailed description of the invention, taken in conjunction with the accompanying drawings.

DETAILED DESCRIPTION OF PREFERRED EMBODIMENT

Figure 1:
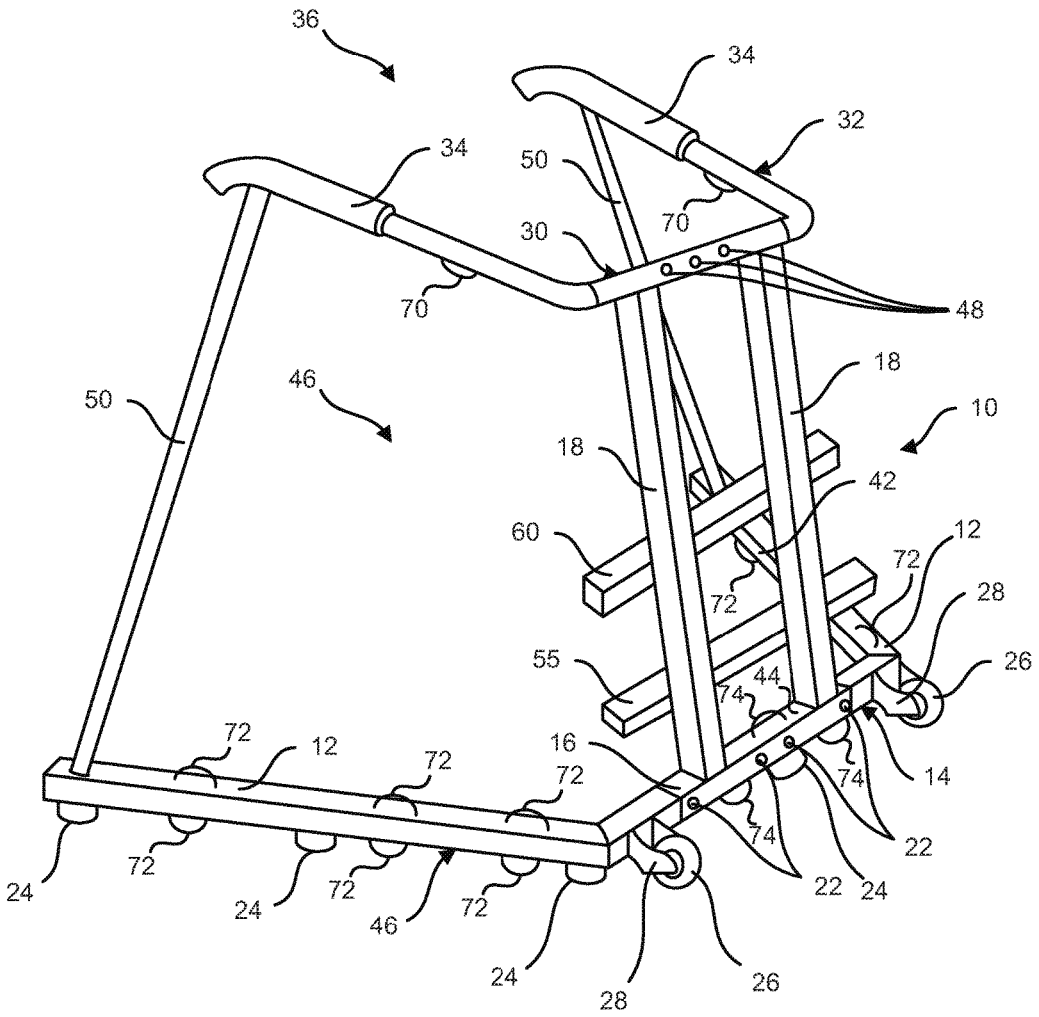
FIG. 1 illustrates a perspective view of one embodiment of a rehabilitation and fitness trainer.
Figure 2:
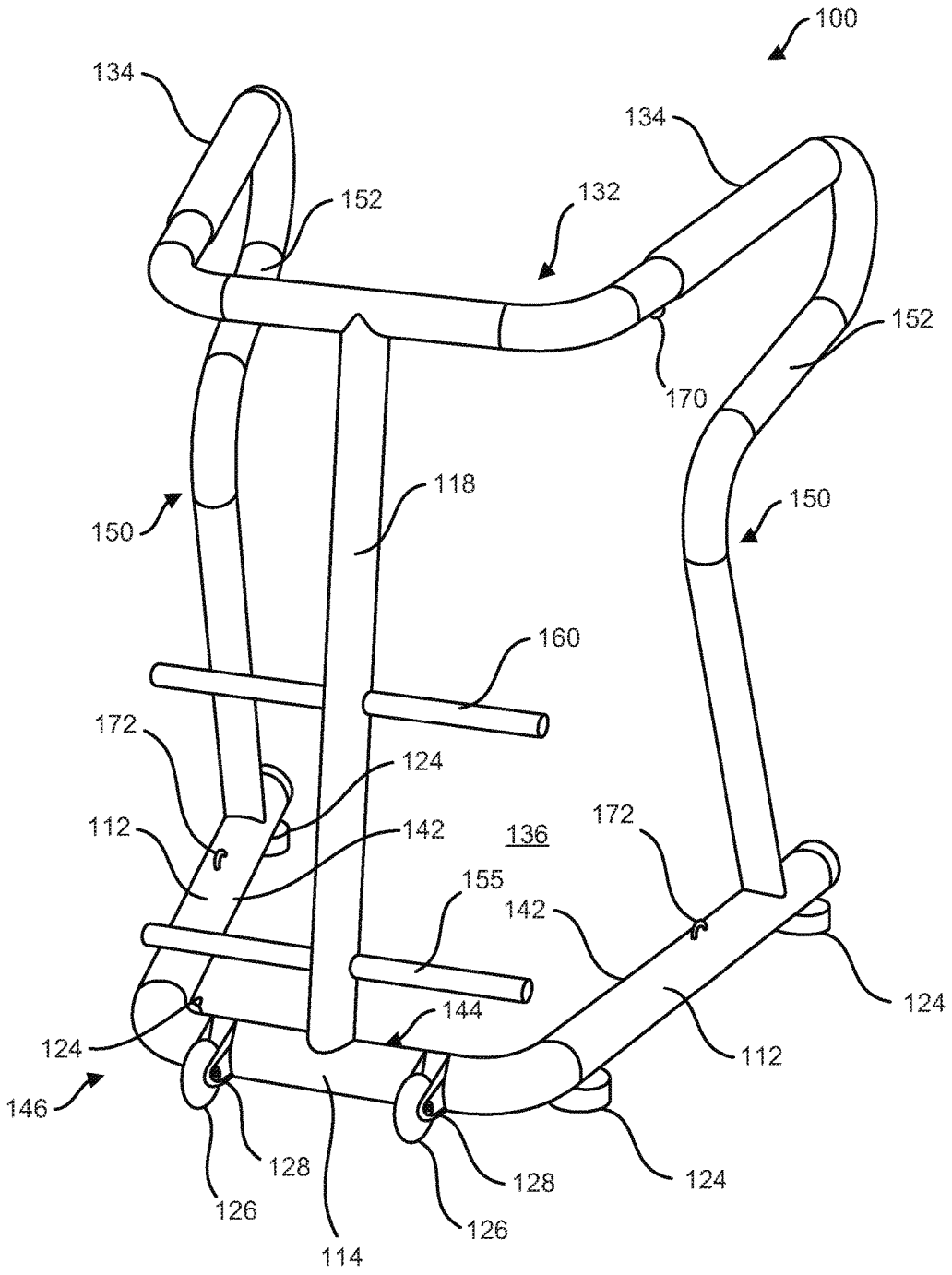
FIG. 2 illustrates a perspective view of another embodiment of a rehabilitation and fitness trainer.
Figure 3:
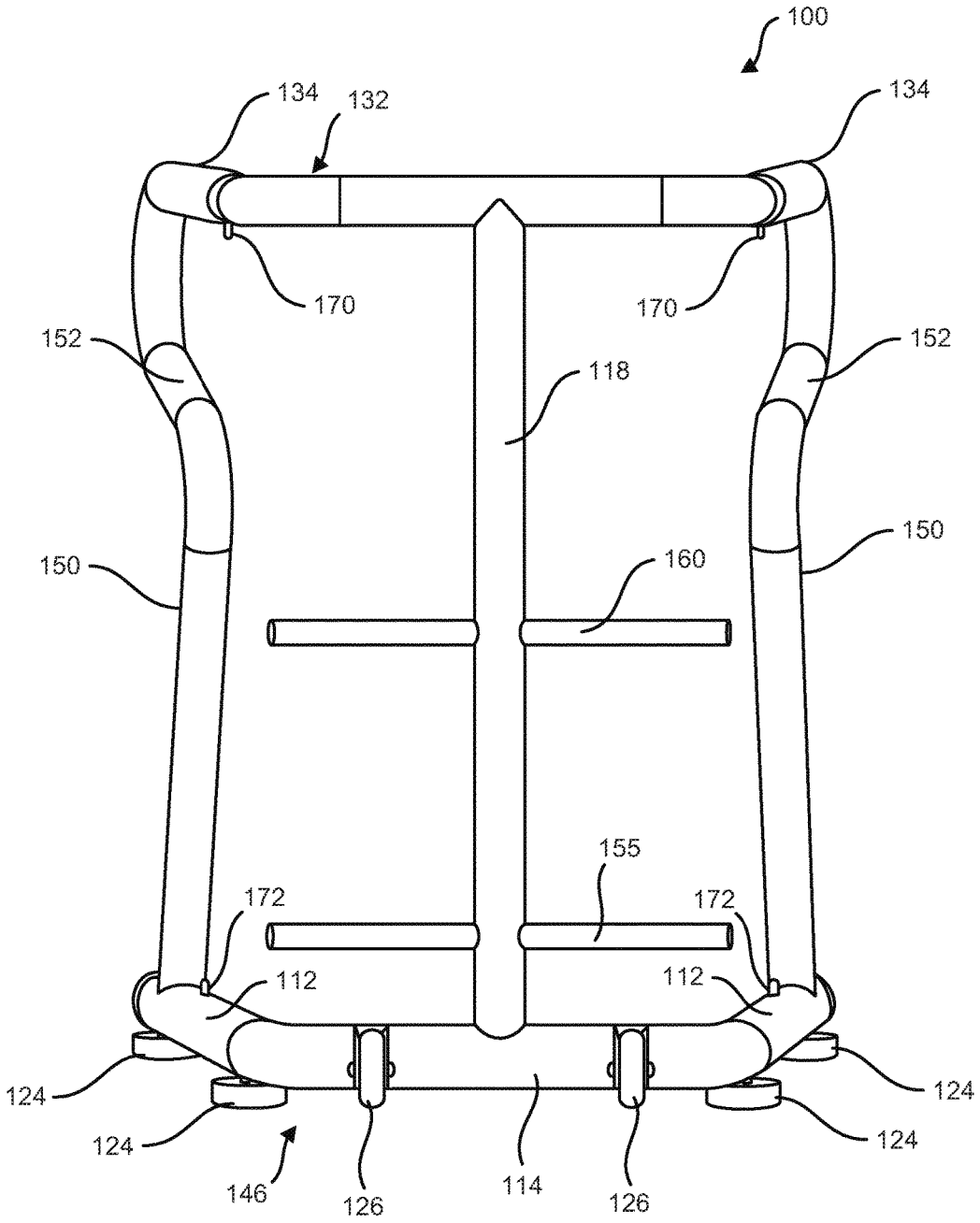
FIG. 3 illustrates a front view of the rehabilitation and fitness trainer of FIG. 2.
Figure 4:
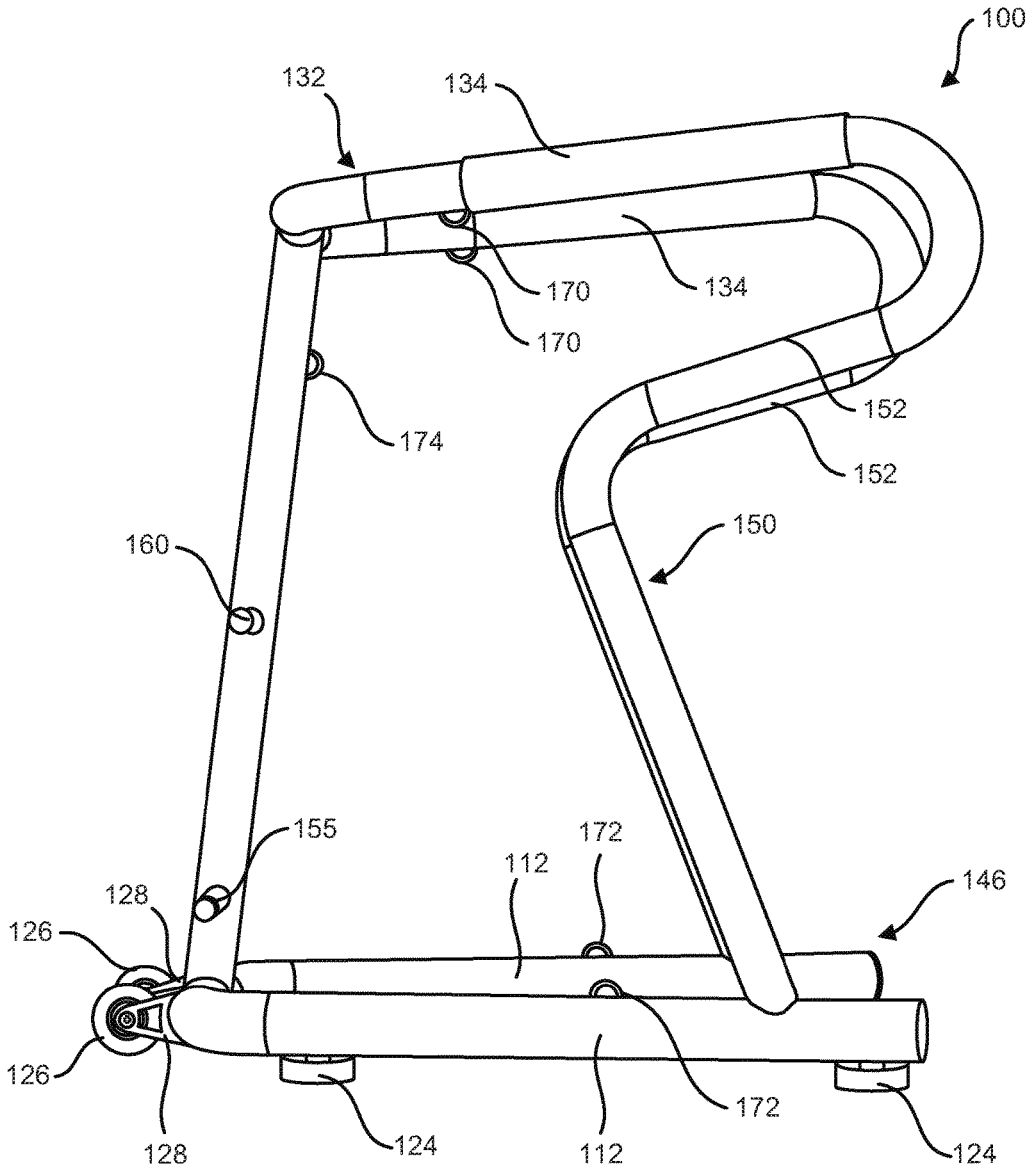
FIG. 4 illustrates a side view of the rehabilitation and fitness trainer of FIG. 2.
Figure 5:
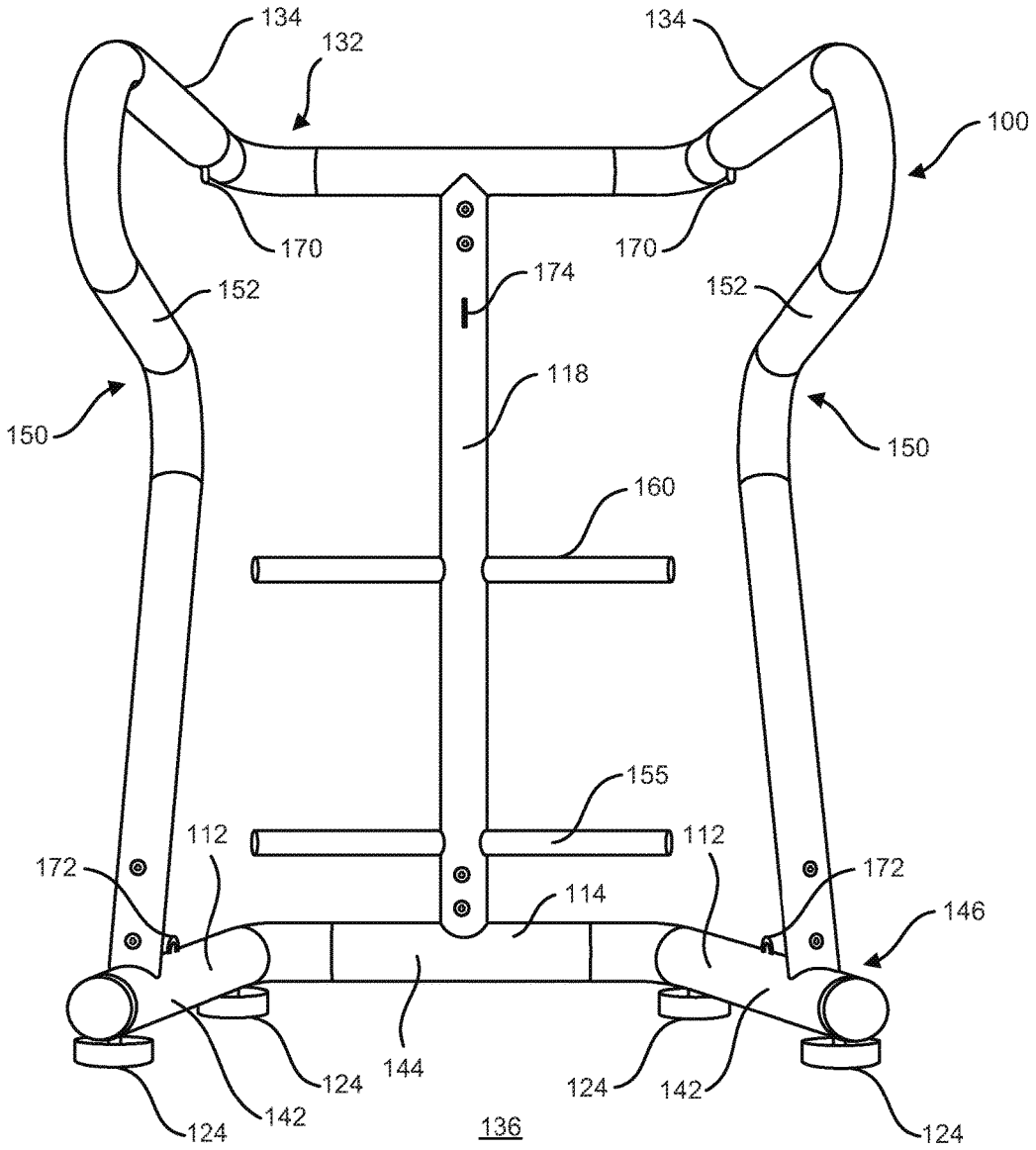
FIG. 5 illustrates a rear view of the rehabilitation and fitness trainer of FIG. 2.

Referring to FIG. 1, a rehabilitation and fitness trainer 10 is suitable to aid in rehabilitation and personal training while providing a stable support mechanism for the individual user. The trainer 10 may be suitable for a safe trainer together with a stable support. The trainer 10 also permits freedom of movement within the trainer 10 and support at least a portion of the weight of the person using it.

The trainer 10 comprises a plurality of base side members 12 with opposing ends, a cross bar 14 with opposing ends, a bracket 16, a plurality of vertical members 18, and hand grips 34. A base frame 46 of the trainer 10 consists of the side members 12, 12, the bracket 16, the cross bar 14, 14 and the vertical members 18, 18. A single vertical member 18 may be used, if desired, which is preferably centered. Attached to each end of the cross bar 14 is the respective side member 12. It is preferable that each side member 12 be detachably connectable to each end of the cross bar 14. Alternatively, the side members 12, 12 may be permanently attached to the cross bar 14. The side members and the cross bar may be a single member, if desired. Both of the side members 12, 12 extend rearward, in the same direction as the open-end 36 of a handle frame 32. The side members 12, 12 may extend straight back while forming right angles with the cross bar 14. The side members 12, 12 may be detachably engageable to the cross bar 14 and the distal ends of the side members 12, 12 are further apart from each other than the ends of the side members 12, 12 that are connected to the cross bar 14. Furthermore, the side members 12, 12 preferably form an angle of 95-125 degrees as measured from an inside face 42 of each side member 12 and a rear face 44 of the cross bar 14. By virtue of the outwardly spreading side members 12, 12, there is sufficient space within the space defined by the base frame 46 to allow a wheel chair bound user to maneuver the wheel chair into the confines of the trainer 10 and thereafter grip the handle frame 32 and exercise their upper body. In addition, the outwardly spreading side members 12 preferably have a maximum width of thirty four inches or less so that it may readily pass through a standard doorway. Furthermore, the outwardly spreading side members 12 permit a plurality of trainers to be stacked within one another for compact storage, such as in a manner similar to that of shopping carts.

Preferably the side members 12, 12 and the cross bar 14 have a circular tubular design made from a metal material, such as aluminum or steel. The side members 12, 12 and the cross bar 14 may also be manufactured from a solid block of material and have different shapes such as rectangular, hexagonal or octagonal. A plurality of feet 24 are disposed on the underside of each side member 12 to separate the side member 12 from the floor support surface of the trainer 10. The feet 24 may stabilize the trainer 10 as well as reduce the damage to the lower surface the trainer 10 is supported thereon. The feet 24 are preferably formed from rubber, but may also be made from other suitable cushioning and non-skid materials, such as plastic or nylon. The feet 24 are preferably detachably attached to the trainer 10 with a respective screw.

A plurality of wheels 26 and a corresponding number of wheel brackets 28 are fixedly attached to the front face of the cross bar 14, with the rotational orientation of the wheel 26 being perpendicular to the longitudinal axis of the cross bar 14. The wheels 26 and the wheel brackets 28 may be located at any other suitable position on the cross bar 14. When an individual is performing exercises, the trainer 10 is stabilized by the side members 12, 12, the cross bar 14, and the feet 24. The tendency of the wheels 26 to roll is overcome by the feet 24 and the side members 12, 12. Before or after use, the individual may relocate the trainer 10 by gripping the handle frame 32, tipping the trainer 10 forwardly so as to lift the feet 24 off of the support surface and applying force in the forward or reverse directions. When the feet 24 are not in contact with the support surface, the wheels 26 will rotate freely and permit the trainer 10 to be easily maneuvered by the user.

The bracket 16 may be detachably engaged with the cross bar 14 by using one or more fasteners 22. The bracket 16 may be affixed to the central region of the cross bar 14. A symmetrical structure of the trainer 10 increases the overall stability of the trainer 10. Extending vertically upward from the bracket 16 are the plurality of vertical members 18 formed from steel, aluminum, or other suitable material for supporting the user's weight. These vertical members are preferably tubular and may be rectangular, round, hexagonal or octagonal in shape. Preferably the vertical members 18, 18 are constructed from a rectangular tubular member and are arranged in a substantially parallel arrangement with one another. Also, the vertical members 18, 18 may be angled slightly in the rearward direction away from the wheels 26. The vertical members 18, 18 may be directly affixed to the cross bar 14. The handle frame 32 may include a bracket 30 supported thereon by a plurality of fasteners 48. The top of each vertical member 18 may be securely fastened to the bracket 30. The vertical members 18, 18 may be directly affixed to the handle frame 32. The handle frame 32 is preferably U-shaped and includes the cushioned hand grips 34, 34. The ends of the hand grips 34, 34 are preferably bent downwardly.

The vertical members 18 are preferably constructed having a fixed length that is not capable of being adjusted in their length. Also, the vertical members 18 are preferably constructed having a fixed orientation with respect to the handle frame 32 and the base frame 46 that is not capable of being adjusted in its orientation. Without the adjustability in the length and/or orientation of the vertical members 18, the trainer 10 is more stable and less susceptible to failure. In this manner, the handle frame 32 is not capable of being adjusted in its height with respect to the base frame 46. However, with the vertical members 18 being fixed in length, it is desirable that the hand frame 32 be forwardly inclined so that the front end of the handle frame 32 is closer to the base frame 46 in a perpendicular direction than the rear end of the handle frame 32 in a perpendicular direction to the base frame 46. With such an inclined handle frame 32, it helps decrease the likelihood of user's tending to fall backwards by the creation of some forward pressure as a result of the user's hands on the handle frame 32. Preferably, the handle frame is 24 to 36 inches in length and inclined at an angle generally between 3 and 30 degrees. In addition, the variable height of the handle frame 32 also accommodates the height of different users by adjusting their location of their exercises along the length of the handle frame 32. Preferably the maximum perpendicular distance between the handle frame 32 is generally 43 inches at the rear, or from generally 37 inches to generally 49 inches, and the minimum perpendicular distance between the handle frame 32 is generally 36 inches at the front, or from generally 30 inches to generally 42 inches. For suitable symmetry, each of the vertical member 18 are preferably the same length as the other.

The handle frame 32 is preferably a round tubular material such as steel, aluminum or another material and is generally U-shaped. The hand frame 32 is preferably formed from the same material as the side members 12. At the free ends of the handle frame 32 are ergonomic coverings of rubber, foam or any other resilient material disposed to form the hand grips 34, 34. An open-end 36 exists at the distal ends of the handle frame 32 between the hand grips 34, 34. In use, the user will enter the open-end 36 of the apparatus 10 and grasp the hand grips 34, 34 for support while performing exercises. The open-end 36 is of sufficient size to permit a number of different body sizes to enter and perform their exercises, including users who require a wheel chair. The open-end of the base frame 46 is sufficiently wide to enable a wheel chair to extend into the base frame to facilitate the user being in a position to comfortably use the trainer 10.

The trainer 10 may include a pair of additional support members 50. The additional support members 50 are preferably slightly inclined in a forward direction toward the front of the trainer 10. Preferably, the support members 50 are oriented in such a manner that they achieve a substantially 90 degree angle between the handle frame 32. The support members 50 increased rigidity and support for the trainer 10 so it is more suitable to withstand forces of 500 pounds or more for a significantly longer time period than if the support members 50 were not included. The support members 50 are preferably attached at one end thereof at a location proximate the end of the respective base side member 12. The support members 50 are preferably attached at another end thereof at a location proximate the hand grips 34, 34. The support members 50 provide additional rigidity to the trainer 10, and further decrease the likelihood that the user will inadvertently fall.

The trainer 10 may include one or more horizontal stretching pegs 55 and 60 that are affixed to the pair of vertical members 18, preferably in a generally horizontal orientation. The lower stretching peg 55 is preferably generally six inches from the floor and the upper stretching peg 60 is preferably generally 16 inches from the floor. The stretching pegs are suitable to place the foot or heel while the user is in a forward orientation and/or hook the foot while the user is in a rearward orientation so that the hamstrings, quads, hips, lower back, calves, and/or trunk may be stretched to increase the mobility of the user. The stretching pegs are also suitable for sideward orientation user activity in order to stretch the inner thigh and hip musculature as well as strengthen the gluteal muscles on the opposite side when one foot is positioned on one of the stretching pegs.

The trainer 10 may include a plurality of hooks and/or partial rings 70 affixed to the lower side of the handle frame 32. The trainer 10 may include a plurality of hooks and/or partial rings 72 affixed to the lower side and/or the upper side of the base side members 12. The trainer 10 may include a plurality of hooks and/or partial rings 74 affixed to the lower side and/or the upper side of the cross bar 14. The rings 70, 72, 74 serve as an anchor for stretchable tubing so that users can perform upper and/or lower body exercises, such as rows bicep curls, chest presses, shoulder presses, etc.

Referring to FIGS. 2-5, another embodiment of a rehabilitation and fitness trainer 100 is suitable to aid in rehabilitation and personal training while providing a stable support mechanism for the individual user. The trainer 100 may be suitable for a safe trainer together with a stable support. The trainer 100 also permits freedom of movement within the trainer 100 and support at least a portion of the weight of the person using it.

The trainer 100 comprises a plurality of base side members 112 with opposing ends, a cross bar 114 with opposing ends, a vertical member 118, and hand grips 134. A base frame 146 of the trainer 100 consists of the side members 112, 112, the cross bar 114, 114 and the vertical member 118. A plurality of vertical members 118 may be used, if desired. Attached to each end of the cross bar 114 is the respective side member 112. It is preferable that each side member 112 be detachably connectable to each end of the cross bar 114. Alternatively, the side members 112, 112 may be permanently attached to the cross bar 114. The side members and the cross bar may be a single member, if desired. Both of the side members 112, 112 extend rearward, in the same direction as the open-end 136 of a handle frame 132. The side members 112, 112 may extend straight back while forming right angles with the cross bar 114, although the side members 112, 112 preferably extend back in a general v-shaped manner. The side members 112, 112 may be detachably engageable to the cross bar 114 and the distal ends of the side members 112, 112 are further apart from each other than the ends of the side members 112, 112 that are connected to the cross bar 114. Furthermore, the side members 112, 112 preferably form an angle of 95-125 degrees as measured from an inside face 142 of each side member 112 and a rear face 144 of the cross bar 114. By virtue of the outwardly spreading side members 112, 112, there is sufficient space within the space defined by the base frame 146 to allow a wheel chair bound user to maneuver the wheel chair into the confines of the trainer 100 and thereafter grip the handle frame 132 and exercise their upper body. In addition, the outwardly spreading side members 112 preferably have a maximum width of thirty four inches or less so that it may readily pass through a standard doorway. Furthermore, the outwardly spreading side members 112 permit a plurality of trainers to be stacked within one another for compact storage, such as in a manner similar to that of shopping carts.

Preferably the side members 112, 112 and the cross bar 114 have a circular tubular design made from a metal material, such as aluminum or steel. The side members 112, 112 and the cross bar 114 may also be manufactured from a solid block of material and have different shapes such as rectangular, hexagonal or octagonal. A plurality of feet 124 are disposed on the underside of each side member 112 to separate the side member 112 from the floor support surface of the trainer 100. The feet 124 may stabilize the trainer 100 as well as reduce the damage to the lower surface the trainer 100 is supported thereon. The feet 124 are preferably formed from rubber, but may also be made from other suitable cushioning and non-skid materials, such as plastic or nylon. The feet 124 are preferably detachably attached to the trainer 100 with a respective screw.

A plurality of wheels 126 and a corresponding number of wheel brackets 128 are fixedly attached to the front face of the cross bar 114, with the rotational orientation of the wheel 126 being perpendicular to the longitudinal axis of the cross bar 114. The wheels 126 and the wheel brackets 128 may be located at any other suitable position on the cross bar 114. When an individual is performing exercises, the trainer 100 is stabilized by the side members 112, 112, the cross bar 114, and the feet 124. The tendency of the wheels 126 to roll is overcome by the feet 124 and the side members 112, 112. Before or after use, the individual may relocate the trainer 100 by gripping the handle frame 132, tipping the trainer 100 forwardly so as to lift the feet 124 off of the support surface and applying force in the forward or reverse directions. When the feet 124 are not in contact with the support surface, the wheels 126 will rotate freely and permit the trainer 100 to be easily maneuvered by the user.

A symmetrical structure of the trainer 100 increases the overall stability of the trainer 100. Extending vertically upward from the cross bar 114 is the vertical member 118 formed from steel, aluminum, or other suitable material for supporting the user's weight. The vertical member is preferably tubular and may be rectangular, round, hexagonal or octagonal in shape. Preferably the vertical member 118 is constructed from a rectangular tubular member and are arranged in a substantially parallel arrangement with one another. Also, the vertical member 118 may be angled slightly in the rearward direction away from the wheels 126. The vertical member 18 may be directly affixed to the cross bar 114. The top of the vertical member 118 may be securely fastened to the handle frame 132. The handle frame 132 is preferably U-shaped and includes the cushioned hand grips 134, 134. The ends of the hand grips 134, 134 are preferably bent downwardly, and more preferably form a curved section.

The vertical member 118 is preferably constructed having a fixed length that is not capable of being adjusted in its length. Also, the vertical member 118 is preferably constructed having a fixed orientation with respect to the handle frame 132 and the base frame 146 that is not capable of being adjusted in its orientation. Without the adjustability in the length and/or orientation of the vertical members 118, the trainer 100 is more stable and less susceptible to failure. In this manner, the handle frame 132 is not capable of being adjusted in its height with respect to the base frame 146. However, with the vertical member 118 being fixed in length, it is desirable that the handle frame 132 be forwardly inclined so that the front end of the handle frame 132 is closer to the base frame 146 in a perpendicular direction than the rear end of the handle frame 132 in a perpendicular direction to the base frame 146. With such an inclined handle frame 132, it helps decrease the likelihood of user's tending to fall backwards by the creation of some forward pressure as a result of the user's hands on the handle frame 132. Preferably, the handle frame is 24 to 36 inches in length and inclined at an angle generally between 3 and 30 degrees. In addition, the variable height of the handle frame 132 also accommodates the height of different users by adjusting their location of their exercises along the length of the handle frame 132. Preferably the maximum perpendicular distance between the handle frame 132 is generally 43 inches at the rear, or from generally 37 inches to generally 49 inches, and the minimum perpendicular distance between the handle frame 132 is generally 36 inches at the front, or from generally 30 inches to generally 42 inches. For suitable symmetry, the vertical member 18 is preferably centered.

The handle frame 132 is preferably a round tubular material such as steel, aluminum or another material and is generally U-shaped. The hand frame 132 is preferably formed from the same material as the side members 112. At the upper portion of the handle frame 132 are ergonomic coverings of rubber, foam or any other resilient material disposed to form the hand grips 134, 134. An open-end 136 exists at the distal ends of the handle frame 132 between the hand grips 134, 134. In use, the user will enter the open-end 136 of the apparatus 100 and grasp the hand grips 134, 134 for support while performing exercises. The open-end 136 is of sufficient size to permit a number of different body sizes to enter and perform their exercises, including users who require a wheel chair. The open-end of the base frame 146 is sufficiently wide to enable a wheel chair to extend into the base frame to facilitate the user being in a position to comfortably use the trainer 100.

The trainer 100 may include a pair of additional support members 150. The additional support members 150 are preferably, in an overall manner, slightly inclined in a forward direction toward the front of the trainer 100, although may include bends therein. Preferably, the additional support members 150 extend a greater distance behind the trainer 100 proximate the handle frame 132 than at a location of the support members 150 being attached to the base frame 146. The additional support members 150 each preferably included a secondary grip 152 that is positioned at a location beneath the respective hand grip 134. The secondary grips 152, 152 facilitate a user in a wheel chair to do exercises and to lift themselves from a sitting position to a standing position. The secondary grips 152, 152 are preferably inclined at an angle of more than 10 degrees difference with respect to the adjoining portions of the support members 150. Also, the secondary grips 152, 152 are preferably inclined at an angle of between 3 degrees and 60 degrees with respect to the floor, and more preferably between 3 degrees and 45 degrees, and more preferably between 3 degrees and 30 degrees. The support members 150 increased rigidity and support for the trainer 100 so it is more suitable to withstand forces of 500 pounds or more for a significantly longer time period than if the support members 150 were not included. The support members 150 are preferably attached at one end thereof at a location proximate the end of the respective base side member 112. The support members 150 are preferably attached at another end thereof at a location proximate the hand grips 134, 134. The support members 150 provide additional rigidity to the trainer 100, and further decrease the likelihood that the user will inadvertently fall.

The trainer 100 may include one or more horizontal stretching pegs 155 and 160 that are affixed to the vertical member 118, preferably in a generally horizontal orientation. The lower stretching peg 155 is preferably generally six inches from the floor and the upper stretching peg 160 is preferably generally 16 inches from the floor. The stretching pegs are suitable to place the foot or heel while the user is in a forward orientation and/or hook the foot while the user is in a rearward orientation so that the hamstrings, quads, hips, lower back, calves, and/or trunk may be stretched to increase the mobility of the user. The stretching pegs are also suitable for sideward orientation user activity in order to stretch the inner thigh and hip musculature as well as strengthen the gluteal muscles on the opposite side when one foot is positioned on one of the stretching pegs.

The trainer 100 may include a plurality of hooks and/or partial rings 170 affixed to the lower side of the handle frame 132. The trainer 100 may include a plurality of hooks and/or partial rings 172 affixed to the lower side and/or the upper side of the base side members 112. The trainer 100 may include one or more hooks and/or partial rings 174 affixed to the interior side of the vertical member 118 The trainer 100 may include a plurality of hooks and/or partial rings affixed to the lower side and/or the upper side of the cross bar 114, if desired. The rings 170, 172, 174 serve as an anchor for stretchable tubing so that users can perform upper and/or lower body exercises, such as rows bicep curls, chest presses, shoulder presses, etc.

The trainer 100 assists a person who has balance difficulty, has weakness in their lower extremities, or is in a rehabilitation mode following an injury or surgery. The trainer 100 may be used by a healthy individual for added support while exercising. The trainer 100 can be used by an individual at a fitness center, physical therapy center, home gym or any location one would like to place it. It can be used one at a time, or many may be set up and used in an aerobics class format.

The trainer 100 may be used to transfer hospital patients (especially obese) to/from bed to reduce staff strain, as the trainer 100 is readily able to withstand forces up to 500 pounds or more.

The trainer 100 may be used for bedside exercises for hospital patients unable to walk due to surgery/injury/disease. Typically, an attending physical therapist will instruct in a standby position.

The trainer 100 may be used as a rehabilitation source for patient post-cardiac event in the patient's hospital room (attending physical therapist may instruct in a standby position).

The trainer 100 may be used as a rehabilitation source for patients post-stroke (attending physical therapist may instruct in a standby position)

The trainer 100 may be used as a rehabilitation source for patients post-traumatic brain injury (attending physical therapist may instruct in standby position).

The trainer 100 may be used as a rehabilitation source for blind patients (attending physical therapist may instruct in standby position).

The trainer 100 may be used as a rehabilitation source for patients with osteoporosis by allowing for safe weight bearing exercise, useful for bone development.

The trainer 100 may be used by physical therapists and occupational therapists to safely use additional balance devices, such as wobble boards, vibration platforms, etc., by positioning such devices within the base area for use in cooperation with the trainer 100.

The trainer 100 may be used to facilitate safe group therapy for up to 20 patients or more at a time in assisted living, skilled nursing, hospitals, outpatient clinics, and retirement facilities; reimbursable via Medicare under CPT code 97150 when services are instructed by a licensed physical therapist or occupational therapist. Verbal cues provided during performing exercises make it suitable to accommodate a wide range of abilities in a Group Therapy class. For example, instructors may tell participants to "step as far forward as you can" in preparation for vestibular training to allow each person to achieve a safe, therapeutic benefit without having to tell each person different instructions. By way of example, the training may involve vestibular, somatosensory, and musculoskeletal systems.

The trainer 100 may be used by physical therapists and occupational therapists to safely use additional devices. One of the additional devices may be a step that may nest in the front one-third of base to facilitate unilateral upward stepping exercises. One of the additional devices may be one or more foam mats that may nest within the base to facilitate greater somatosensory and musculoskeletal training during specific exercises, both being suitable to balance improvements and fall risk reduction. One of the additional devices may be tubing that connects to the hooks to facilitate upper body exercises.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An exercise apparatus, for use on a floor, comprising:

(a) a handle frame having a generally U-shaped handle portion, said handle portion having a base member, a first arm and a second arm, a plane of said handle portion being inclined with respect to the floor by at least 3 degrees;

(b) a generally U-shaped base frame suitable to be positioned on said floor, having an elongated cross bar and two side members extending rearwardly from said elongated cross bar, said side members extending outwardly relative to each other, each said side member being disposed radially outwardly from said cross bar such that a planar configuration of the base frame is larger than a planar configuration of the handle frame, said base frame including an elongated vertical member extending generally upwardly and rearwardly from said cross bar, said elongated vertical member affixed between said handle frame and said base frame such that the distance between said handle frame and said base frame is not capable of being adjusted;

(c) a pair of supports interconnecting an end portion of respective said side members and an end portion of respective said first arm and said second arm, wherein each of said supports includes a first curved section having a first end thereof interconnected to a respective said first arm and said second arm and having a second end thereof, where each of said supports includes a first generally horizontal section having a first end thereof interconnected to a respective said second end of first curved section and having a second end thereof, wherein said first generally horizontal sections are inclined downward toward said cross bar, where each of said supports includes a first generally vertical section having a first end thereof, and having a second end thereof interconnected to said respective said side member, wherein respective said first ends of said first generally vertical sections are interconnected with respective said second end of said first generally horizontal sections with a respective second curved portion, wherein said first generally vertical sections are inclined upward toward said handle portion, wherein each of said first generally horizontal sections being inclined with respect to the floor at an angle less than a remaining portion of a respective said support.

2. The exercise apparatus as in claim 1, wherein each said side member forms an angle between generally 95 and 125 degrees with a longitudinal axis of the elongated cross bar.

3. The exercise apparatus of claim 1, wherein a pair of wheels are disposed on a front of said elongated cross bar for facilitating movement of the apparatus on the floor.

4. The exercise apparatus of claim 1, wherein a plurality of feet are disposed on a bottom side of each said side member of the generally U-shaped base frame.

5. The exercise apparatus of claim 1, wherein a gripping section at a distal end of each arm is covered with a cushioning material.

6. The exercise apparatus of claim 1, further comprising a plurality of hooking structures affixed to a surface of said base frame suitable to affix a flexible band thereto.

7. The exercise apparatus of claim 1, further comprising a first stretching peg affixed to said elongated vertical member in a generally horizontal orientation at a location between said base frame and said handle frame.

8. The exercise apparatus of claim 7, further comprising a second stretching peg affixed to said elongated vertical member in a generally horizontal orientation at a location between said first stretching peg and said handle frame.

* * * * *